US006151786A

United States Patent [19]

Hellstern

[11] Patent Number: 6,151,786

[45] Date of Patent: Nov. 28, 2000

[54] CERAMIC BLADE

[75] Inventor: Peter Hellstern, Villingen-Schwenningen, Germany

[73] Assignee: Sternplastic Hellstern GmbH & Co. KG, Germany

[21] Appl. No.: 09/180,545

[22] PCT Filed: May 7, 1997

[86] PCT No.: PCT/DE97/00959

§ 371 Date: Oct. 11, 1998

§ 102(e) Date: Oct. 11, 1998

[87] PCT Pub. No.: WO97/43095

PCT Pub. Date: Nov. 20, 1997

[30] Foreign Application Priority Data

May 10, 1996 [DE] Germany ..... 196 188 032

[51] Int. Cl.[7] ..... B26B 9/00

[52] U.S. Cl. ..... 30/346.53; 30/346; 30/357

[58] Field of Search ..... 30/350, 357, 346, 30/346.53, 346.54, 356, 355, 345, 346.51

[56] References Cited

U.S. PATENT DOCUMENTS

| | | | |
|---|---|---|---|
| 2,279,833 | 4/1942 | Madan | 30/356 |
| 2,566,112 | 8/1951 | Barnard | 30/350 |
| 3,035,344 | 5/1962 | Brown | 30/346 |
| 3,252,219 | 5/1966 | Kaneko | 30/355 |
| 3,543,402 | 12/1970 | Seager | 30/346.53 |
| 5,077,901 | 1/1992 | Warner et al. | 30/346.53 |

*Primary Examiner*—Hwel-Siu Payer
*Attorney, Agent, or Firm*—Pendorf & Cutliff

[57] ABSTRACT

Ceramic blade (1) of a cutting tool, in particular a knife, with a cutting edge (10) and a rounded off upper edge (12) running opposite to the cutting edge (10). The rounded off upper edge (12) makes possible, in comparison to the conventional sharp-edged transitions, a substantial increase in the break resistance in the case of bending forces.

16 Claims, 1 Drawing Sheet

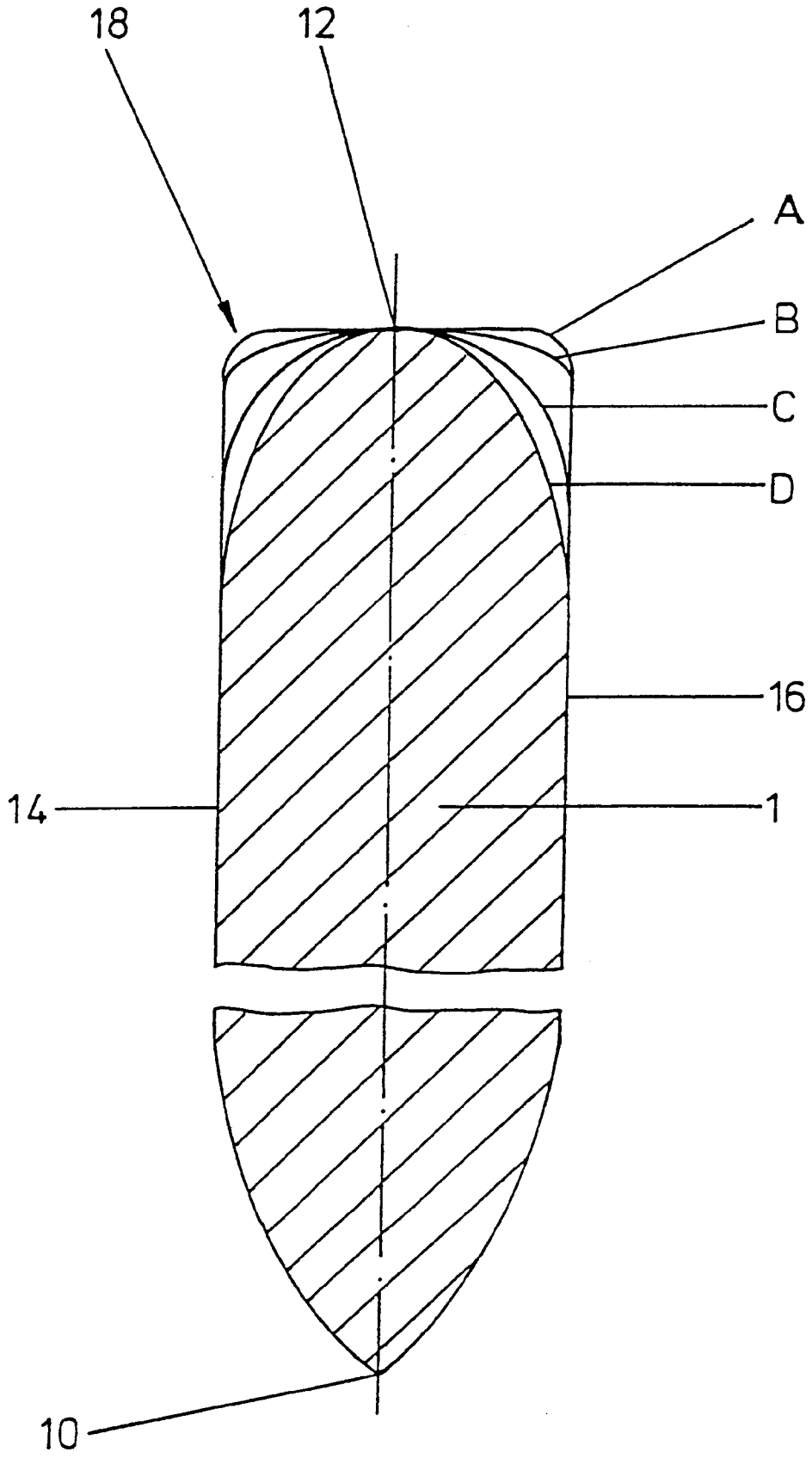
18
12
A
B
C
D
16
14
1
10

CERAMIC BLADE

BACKGROUND OF THE INVENTION

1. Field of the Invention

The invention concerns a ceramic blade for a cutting tool, in particular a knife.

2. Description of the Invention

Until now the available blades of a cutting tool, in particular a knife, have been made almost exclusively of steel. They comprise a cutting edge, which transitions into two side surfaces, and an upper surface running opposite to the cutting edge. Further, securing means in the form of cover plates or link plates or the like are provided, via which it is possible to secure to the grip or handle. In the case of pocket knives a bore hole is provided, through which a mounting bolt anchored in the handle passes, so that the blade can be folded in.

The upper surface of the blade is formed as a planar surface and is relatively broad by design, so that by placement of the index finger or, as the case may be, by application of the palm of the hand, the user can exercise force from above and the cutting edge can be pressed into the material to be cut and/or drawn through it. The transition to the sides is designed to be sharp-angled.

Occasionally cutting tools in the form of knives have been available in commerce, of which the blades are made of a ceramic material. In comparison to the steel blades described in the introductory part above, these possess the advantage of a higher wear resistance, which translates into a substantially higher usable life. A re-sharpening or re-grinding is not necessary following conditions of normal use.

These ceramic blades do not differ from the conventional steel blades with respect to their geometric design, of which the shape has remained unchanged.

Although ceramic blades represent an excellent alternative to the hitherto employed steel blades, a series of disadvantages has come to light in daily conventional use, which until now have hindered their broad acceptance. So it has been found, that this type of blade is highly liable to breakage as soon as a certain bending strain is exceeded. In particular, with very hard ceramic materials, such as for example aluminum oxide, this results as a rule in the premature termination of the usable life, since bending forces can hardly be avoided in daily use. The end of the useful life is thus frequently reached early as a result of an unintentional bending force, although the cutting edge remains fully functional as necessary for the cutting function.

SUMMARY OF THE INVENTION

The invention is thus concerned with the task, of further developing a ceramic blade of the type described above, so that it no longer exhibits the above described disadvantages. In particular it should be ensured, that it is substantially not sensitive to bending forces, thus avoiding a premature failure or breakage as a consequence of breaking due to bending.

The invention is based upon the idea, of rounding off the upper surface as it transitions to the side surfaces of the blade. In comparison to the normal conventional shoulder or step, in which the danger of breakage is minimized by increasing the thickness of the blade, it is shown in surprising manner, that even a comparatively small radius is sufficient to substantially reduce the damage of breakage from bending even though the thickness of the blade remains the same. The effect is believed to essentially be based upon the principle, that the blade tensions inevitably are formed during sintering in the hitherto conventional sharp-edged embodiments can substantially be reduced. These tensions are responsible for the formations of cracks which have been found to occur upon bending.

At the same time the resistance to breakage of the edge of the blade is substantially increased. So there have occurred very rapidly in the conventionally employed ceramic blades fractures in the area of transition from the side surface to the upper surface, in particular, upon impacting of the blade with a hardened object. This problem substantially does not occur in blades with rounded off upper surfaces, so that they can be employed in daily use with substantially less danger of damage.

As a further advantage of the rounded off upper surface, it has been observed, that also the danger of damage of utensils, with which the ceramic blade comes into contact, is substantially reduced. This situation is relevant in particular when cutting tools with ceramic blades are cleansed together with conventional utensils in a dishwashing machine. The revolving cleaning and rinsing stream causes movement of the utensils located in the utensil basket, so that these continuously come into contact with each other. Because of the substantially higher hardness in comparison to other materials which are conventionally employed for utensils, the danger of damage from the sharp edges is particularly high. Here also the ceramic blade formed with rounded off edges according to the invention exhibit further advantages.

A noticeable improvement of the resistance to bending breakage occurs then, when the transition from the upper surface to the side surface is provided with a relatively small radius. Therewith the hitherto conventional appearance of the blade can substantially be maintained, since its upper surface can continue to be so designed. The small radius is provided substantially immediately adjacent to the transition area to the side surfaces. Therewith there continues to remain a larger surface available for tactile engagement in order—as discussed above—to exercise force from above via the index finger or the hand.

Substantial improvements in the resistance to breakage can already be measured with radiuses of larger than 0.3 to 0.5 mm. With conventional blade breadths of 0.5 to 4.5 mm, there remains therewith a large planar section extending along the area of the upper surface.

As optimal in the sense of the presently discussed mechanical characteristics there have however also been found embodiments or designs of the upper surface which are in the shape of half ellipses or semi-circles. This means that the upper surface is continuously curved between the two side surfaces of the blade. The outstanding mechanical characteristics are believed to be attributable to the almost ideally evenly distributed tension during the sintering process.

A further improvement of the mechanical characteristics results in the case that the blade is produced in the injection molding process. This process makes possible in an ideal manner a homogeneous construction of the structure, which can also be maintained even in the case of complex shapes and with variations of the cross sections, for example, in the area of the tip. Also the shaping or formation of the article can be achieved with that level of precision, such that subsequent to sintering a follow-up processing is no longer required. This concerns in particular also the cutting edge, which does not require any further handling or treatment. This aspect in particular is of great importance, since in the known manner in ceramic articles the breaking off of individual micro-structures or grains during processing can occur. Further, fractures can be induced in the grain during the final processing, which substantially increases the susceptibility to bending-breakage.

As ceramics, particularly preferably ceramic oxides, aluminum oxide ($Al_2O_3$) or zirconium oxide ($ZrO_2$) are employed for example. Aluminum oxide, in particular with high purity (for example higher than 95%) produces a particularly high wear resistance. Zirconium oxide in comparison is less wear resistant, however, imparts to the blade a very high elasticity. It has thus been found optimal to employ a mixture of aluminum oxide and zirconium oxide, which combines both characteristics.

BRIEF DESCRIPTION OF THE DRAWINGS

The invention is now further discussed on the basis of the embodiments represented in the FIGURE. The single FIGURE shows the inventive ceramic blade in cross-section with various design contours of the upper surface.

DETAILED DESCRIPTION OF THE INVENTION

The blade 1 exhibits a cutting edge 10 which corresponds to the lower cutting point of two opposite lying cutting surfaces 14, 16. In the shown embodiments the side surfaces 14, 16 run upwards essentially in parallel and transition respectively into the upper surface 12 which connects the two side surfaces 14, 16.

In the FIGURE four alternative embodiments (contour shapes A, B, C, D) are shown.

The contour A corresponds substantially with known embodiments of this type blade with the difference, that at the transition from the upper surface 12 to the respective side surfaces 14, 16 a radius 18 is formed. The radius is herein selected to be very small, so that the upper surface 12 now as before is designed to be substantially planar (and, in the shown embodiment, running horizontally).

The contour B possesses the form of a half ellipse, wherein the large half axis cuts the two side surfaces 14, 16' at right angles.

The contour D is likewise a half ellipse, wherein however different from the contour B the smaller half axis cuts the two side surfaces 14, 16 at right angles.

The contour C is a half circle or semi-circle or hemisphere and imparts optimal compromise with respect to, on the one hand, the mechanical characteristics and, on the other hand, the manipulatability by the user. The contour of the semi-circle C represents the maximal possible radius which can be realized. Beginning with the one side surface the transition to the apex of the upper surface 12 and the subsequent return curve to the oppositely lying side surface occurs with constant curvature so that during the sinter process tensions which occur are distributed evenly as is ideal.

What is claimed is:

1. A ceramic blade having a cutting edge (1), two side surfaces, and an upper edge, the cutting edge (1) transitioning to the two side surfaces, the two side surfaces transitioning to the upper edge, and the upper edge running opposite to the cutting edge, wherein the upper edge (12) is rounded off with respect to the side surfaces (14, 16).

2. The blade according to cliam 1, wherein said blade forms part of a cutting tool.

3. The blade as in claim 2, wherein said cutting tool is a knife.

4. The blade according to claim 1, wherein said upper edge (12) transitions to both side surfaces with a curve (18) forming a radius.

5. The blade according to claim 4, wherein said radius is larger than 0.3 mm.

6. The blade according to claim 4, wherein said radius is greater than 0.5 mm.

7. The blade according to claim 1, wherein said upper edge (12) in cross-section is in the form of a half ellipse (B; D).

8. The blade according to claim 1, wherein said upper edge (12) in cross-section is in the form of a semi-circle (C).

9. The blade according to claim 1, wherein said blade is produced by an injection molding process.

10. The blade according to claim 1, wherein said blade is made of ceramic and said ceramic is a ceramic oxide.

11. The blade according to claim 10, wherein said ceramic oxide is aluminum oxide, zirconium oxide or a mixture thereof.

12. A method for enhancing the break strength of a ceramic blade having a cutting edge (1), two side surfaces, and an upper edge, the cutting edge (1) transitioning to the two side surfaces, the two side surfaces transitioning to the upper edge, and the upper edge running opposite to the cutting edge, the method comprising rounding off the area of transition between the upper edge (12) and the side surfaces (14, 16).

13. A method according to claim 12, wherein said upper edge (12) transitions to both side surfaces with a curve (18) forming a radius.

14. A method according to claim 13, wherein said radius is larger than 0.3 mm.

15. A method according to claim 13, wherein said radius is greater than 0.5 mm.

16. A method according to claim 12, wherein said upper edge (12) in cross-section is in the form of a half ellipse (B; D).

* * * * *